US011134718B2

(12) United States Patent
Reed et al.

(10) Patent No.: US 11,134,718 B2
(45) Date of Patent: Oct. 5, 2021

(54) SMOKING ARTICLE

(71) Applicant: ESSENTRA FILTER PRODUCTS DEVELOPMENT CO. PTE. LTD, Singapore (SG)

(72) Inventors: James Reed, Buckinghamshire (GB); Jian Xiang, Richmond, VA (US)

(73) Assignee: Essentra Filter Products Development Co. Pte. Ltd, Singapore (SG)

( * ) Notice: Subject to any disclaimer, the term of this patent is extended or adjusted under 35 U.S.C. 154(b) by 406 days.

(21) Appl. No.: 15/129,303

(22) PCT Filed: Mar. 26, 2015

(86) PCT No.: PCT/EP2015/056552
§ 371 (c)(1),
(2) Date: Sep. 26, 2016

(87) PCT Pub. No.: WO2015/144822
PCT Pub. Date: Oct. 1, 2015

(65) Prior Publication Data

US 2017/0105450 A1 Apr. 20, 2017

Related U.S. Application Data

(60) Provisional application No. 61/971,095, filed on Mar. 27, 2014.

(30) Foreign Application Priority Data

Apr. 22, 2014 (GB) ..... 1407056

(51) Int. Cl.

| | |
|---|---|
| ***A24F 40/46*** | (2020.01) |
| ***A24F 40/42*** | (2020.01) |
| ***H05B 3/00*** | (2006.01) |
| ***A24F 40/10*** | (2020.01) |

(52) U.S. Cl.
CPC ..... *A24F 40/46* (2020.01); *A24F 40/42* (2020.01); *H05B 3/0014* (2013.01); *A24F 40/10* (2020.01); *H05B 2203/021* (2013.01)

(58) Field of Classification Search
None
See application file for complete search history.

(56) References Cited

U.S. PATENT DOCUMENTS

| | | | | |
|---|---|---|---|---|
| 3,297,041 A * | 1/1967 | Sproull | A24D 3/14 | 131/342 |
| 3,461,880 A * | 8/1969 | Stubblefield | A24D 3/16 | 131/331 |
| 5,190,061 A * | 3/1993 | Brackmann | A24D 3/045 | 131/331 |
| 5,303,720 A * | 4/1994 | Banerjee | A24F 47/004 | 131/194 |

(Continued)

FOREIGN PATENT DOCUMENTS

| | | |
|---|---|---|
| WO | 2013083634 A1 | 6/2013 |
| WO | 2014/064087 A1 | 5/2014 |

*Primary Examiner* — Thor S Campbell
(74) *Attorney, Agent, or Firm* — Sheppard Mullin Richter & Hampton LLP

(57) ABSTRACT

The present invention relates to smoking articles, for example electronic cigarettes (h referred to as "e-cigarettes"), and fluid reservoirs for use therewith or therein.

5 Claims, 1 Drawing Sheet

(56) References Cited

U.S. PATENT DOCUMENTS

Figure 1:
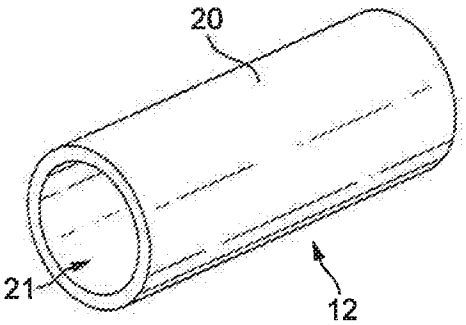

| | | | | |
|---|---|---|---|---|
| 5,524,647 | A * | 6/1996 | Brackmann | A24D 1/00 131/339 |
| 5,607,766 | A | 3/1997 | Berger | |
| 2003/0208175 | A1* | 11/2003 | Gross | A61F 13/53 604/378 |
| 2004/0003822 | A1* | 1/2004 | Atindranath | A24D 1/00 131/364 |
| 2004/0116017 | A1* | 6/2004 | Smith, III | A45D 40/00 442/123 |
| 2005/0186299 | A1 | 8/2005 | Berger et al. | |
| 2008/0073226 | A1 | 3/2008 | Stoltz et al. | |
| 2011/0206471 | A1* | 8/2011 | Doshi | C04B 14/064 408/1 R |
| 2011/0226236 | A1 | 9/2011 | Buchberger | |
| 2013/0292492 | A1* | 11/2013 | Akitsu | B05B 17/0646 239/331 |
| 2014/0205272 | A1* | 7/2014 | Midgette | A01M 1/2077 392/395 |
| 2014/0261487 | A1* | 9/2014 | Chapman | D04C 1/06 131/328 |
| 2014/0345635 | A1* | 11/2014 | Rabinowitz | A24B 15/16 131/352 |
| 2015/0014435 | A1* | 1/2015 | Chu | B05B 17/0684 239/102.2 |
| 2018/0007962 | A1* | 1/2018 | Hunt | A24F 47/008 |

* cited by examiner

SMOKING ARTICLE

CROSS-REFERENCE TO RELATED APPLICATIONS

This application is a national stage application pursuant to 35 U.S.C. § 371 of International Application No. PCT/EP2015/056552, filed Mar, 26, 2015, which claims priority U.S. Provisional Application No. 61/971,095 filed Mar. 27, 2014 and to Great Britain Patent Application No. 1407056.9, filed Apr. 22, 2014, the disclosures of which are hereby incorporated by reference.

The present invention relates to smoking articles, for example electronic cigarettes (herein referred to as "e-cigarettes"), and fluid reservoirs for use therewith or therein.

An electronic or e-cigarette is a well-known type of aerosol-generating device that enables the user to simulate the act of smoking. E-cigarettes produce a vapour that when inhaled can replicate the sensation and often the flavour of tobacco smoke, but without the associated odours. They use heat and airflow to vaporise a solution that often contains nicotine and a range of flavours for delivery to the consumer.

E-cigarettes generally include three main sections—a battery, an atomizer and a cartridge—and are available as either disposable or re-usable devices. They can be supplied in one, two or three parts—in two-part devices, the atomizer and cartridge are combined in a single unit (also known as a cartomizer). In general, the battery compartment contains a flow sensor and an indicator light, whilst the atomiser will typically comprise a porous material in proximity to a heating element to enable liquid transferred from a reservoir to be delivered to the heating element where it is converted into vapour for delivery to the user (when the flow sensor detects that puffing has occurred). The cartridge connects to the atomizer and comprises the reservoir containing a solvent—normally glycerol, or propylene glycol or a mixture of the two—together with water, various flavours and nicotine—known as an e-liquid. The atomiser is a porous material in contact with the reservoir and is designed to present a high surface area of solution to the flow path. The heating element can either be in direct contact with the atomiser or remote from it. When the device is puffed a flow sensor activates the heating element so that the atomizer is heated or heated air is passed over the atomiser to convert some liquid into vapour for delivery to the user.

E-cigarettes have increased rapidly in popularity in recent years, but are subject to various shortcomings in terms of consumer satisfaction. In particular, electronic cigarettes are more variable in comparison to regular cigarettes in terms of the control of intensity of flavour delivery to the user. Various improvements, particularly to atomiser design, have been proposed to address these problems but there remains an issue of insufficient aerosol delivery associated with such products. A further problem of variability is the number of puffs a consumer can take from an e-cigarette before the device fails (either due to battery exhaustion or the reservoir being depleted). It is frustrating for the consumer for there to be a great variability in the number of puffs he/she can obtain from the device. The current invention addresses both of these problems by providing an aerosol-generating device that more reproducible in terms of puff-to-puff flavour delivery and the total number of puffs that can be taken from the device.

Current electronic cigarettes utilize a number of means to hold and release the e-liquid that typically contains 1-10% nicotine. Efficient transfer of nicotine to the vapour is one of the main metrics that is desirable for the consumer. Current products use one of two main types of reservoir to hold the liquid—tanks and fibrous reservoirs. The current invention concerns improvements to fibrous reservoirs.

Fibrous reservoirs can be either single or multi construction. Single construction reservoirs are typically comprised of a non-woven batt that has been calendared or needle punched to create a liquid holding structure. This structure can be defined as high loft thickness exceeding 1 mm or low loft which is less 1 mm in thickness. Single construction reservoirs have either one layer (around a sleeve and the heating element located within the sleeve) or a plurality of layers constructed by rolling the material. The latter construction has the advantage of increasing the liquid-carrying capacity, but is associated with highly variable release of the nicotine solution. In addition, as the material is spiralled on itself by the rolling process, the construction does not lend itself to automation. Previous attempts to reduce this variation in nicotine release, and improve the efficiency of transfer, have led to multi construction reservoirs that comprise an inner reservoir of a low loft material and an outer component of a high loft material. The high loft material acts as a liquid holding medium, whilst the low loft material provides quick release of the liquid solution to the aerosol generation means. However, this construction still does not provide suitable characteristics.

It is desirable to have a reservoir whose manufacture can be automated and can provide a high and consistent transmission of nicotine and other components to the heating element and thus to the user following conversion to the vapour state.

According to the present invention there is provided a fluid reservoir (e.g. for a smoking article such as an electronic cigarette) comprising a (e.g. porous) element comprising (e.g. formed from) a plurality of bicomponent fibres; and, optionally, a fluid (e.g. disposed on or in the element).

Preferably the element is a longitudinally extending (e.g. rod shaped) element. Preferably the longitudinally extending element comprises a plurality of bicomponent fibres which define at least one channel extending longitudinally of the element. Preferably the (or each) channel extends along the full length of the element. The longitudinally extending element may comprise a plurality of bicomponent fibres which define two or more channels extending longitudinally of (e.g. through) the element.

The longitudinally extending element may be substantially cylindical (e.g. having a circular cross section). In an example, the longitudinally extending element is a tubular element (e.g. having annular cross section). Preferably the longitudinally extending element has uniform cross section. The longitudinally extending element may be a longitudinally extruded element.

According to the present invention in a further aspect there is provided a fluid reservoir (e.g. for a smoking article such as an e-cigarette) comprising a longitudinally extending (e.g. porous) tubular element (e.g. of annular cross section) comprising (e.g. formed from) a plurality of bicomponent fibres; and optionally a fluid (e.g. disposed on or in the element). The bicomponent fibres which form the tubular element define a single hollow channel of circular cross section extending longitudinally of (e.g. through) the tubular element. Preferably, the hollow channel extends along (e.g. through) the full length of the element.

The fluid reservoir [(e.g. porous) element, (e.g. porous) tubular element] of the invention may have an outer diameter 7 to 8 mm (e.g. 7.5 mm). The fluid reservoir (tubular element) of the invention may have an inner diameter 3.0 to 5.0 mm (e.g. 4.25 mm). The fluid reservoir (tubular element)

of the invention may have wall thickness (that is, one half the difference between the inner diameter and the outer diameter) of 1.25 mm or greater. The fluid reservoir (tubular element) of the invention may have length 28 to 38 mm, for example 33 mm. The fluid reservoir is dimensioned to fit within the housing or body of the smoking article, and may surround other components of the smoking article if these are located within the channel.

Preferably the element (e.g. tubular element) is porous.

Preferably the element (e.g. tubular element) is self supporting.

The fluid reservoir comprises a plurality of bicomponent fibres (e.g. sheath-core bicomponent fibres) which are bonded to each other at (e.g. spaced apart) contact points to form the (e.g. longitudinally extending, e.g. tubular, e.g. porous) element. The choice of materials which make up the bicomponent fibres defines the thermal stability and chemical compatibility of the fibrous fluid reservoirs to nicotine liquid. The characteristics of fibre regarding fibre size and shape define the porosity and capillarity of the element/reservoir, which in turn dictates its nicotine holding capacity and the rate at which nicotine is released (to the atomiser). It will be appreciated that the fluid reservoir may function as nicotine storage and delivery component for the electronic cigarette.

Bicomponent fibres are well known, from e.g. U.S. Pat. No. 5,607,766. Herein, the term "bicomponent fibre" means a fibre comprising two components which has a cross section, extending along the length of the fibre, wherein the two components are separated into relatively distinct component regions. The term bicomponent fibre includes fibres which include a core of one material (first component) surrounded by a sheath of another material (second component). Such a sheath-core arrangement may include a configuration wherein a monocomponent fibre (such as cellulose acetate) is coated with another component (e.g. a plasticiser). The term bicomponent fibre includes other arrangements such as those wherein the cross section extending along the length of the fibre includes the two components arranged side-by-side or layer-by-layer; those wherein the cross section extending along the length of the fibre includes the first components disposed as discrete areas (islands) within the second component (sea); and those wherein the cross section extending along the length of the fibre includes the components arranged as alternating wedge shaped segments (e.g. looking like a pie with alternating slices of different components).

It is preferred that the bicomponent fibres include a core of one material (first component) surrounded by a sheath of another material (second component).

Preferably the bicomponent fibres comprise a core (first component) of polypropylene or polybutylene terephthalate, surrounded with a sheath (second component) of polyethylene terephthalate or a copolymer thereof. In other examples, the core or sheath may be a polymer selected from the group consisting of polyamides, polyolefins, polyesters, polyvinyl chloride, ethylene/acrylic acid copolymers and salts of same, ethylene/methacrylic acid copolymers and salts of same, ethylene vinyl acetate, plasticized cellulose acetate, polystyrene, polysulfones, polyphenylene sulfide, polyacetals, and polymers comprising blocks of polyethylene glycol, copolymers thereof and derivatives thereof.

The bicomponent fibres may have an average diameter of 2 to 50 microns, preferably 5 to 40 microns, more preferably 10 to 30 microns, more preferably 15 to 25 microns, for example 20 or 25 microns. The bicomponent fibres may have an average diameter of 5 to 30 microns, for example 10 to 20 microns, for example 15 microns.

The longitudinally extending element may comprise a plurality of bicomponent fibres at a bonded fibre density of 0.05 to 0.50 g/cc, preferably 0.10 to 0.44 g/cc, preferably 0.15 to 0.30 g/cm, preferably 0.17 to 0.26 g/cc, for example 0.21 g/cc.

According to the present invention in a further aspect there is provided a fluid reservoir comprising a porous element comprising a plurality of bicomponent fibres at a bonded fibre density of 0.17 to 0.26 g/cc; and, optionally, a fluid.

A major advantage of reservoirs according to the invention is that they can be manufactured on a mass scale to highly reproducible specifications and can be easily incorporated into the manufacture of e-cigarettes. The reservoir of the invention may advantageously offer a better "extraction efficiency", meaning more fluid may be removed from the reservoir in use than with conventional reservoirs. Further, advantageously, the reservoir of the invention may be formed from virgin fibre and/or may not require the use of any processing aids such as antistatic, lubricate, bonding agent or surfactant. This means that the reservoir of the invention may be inert to, or may not interfere with, the chemistry of the liquid they hold.

The longitudinally extending element may be formed by a melt blowing process, for example similar to processes described in U.S. Pat. No. 5,607,766 or U.S. Pat. No. 6,103,181. U.S. Pat. No. 5,607,766 describes the manufacture and use of bicomponent melt blown fibres, typically comprising a core of polypropylene or polybutylene terephthalate surrounded by a sheath of polyethylene terephthalate. U.S. Pat. No. 6,103,181 describes the manufacture and use of bimodal melt blown fibres, comprising fibres of differing characteristics extruded from the same die (e.g. different monocomponent fibres, different bicomponent fibres or mixtures thereof). These documents describe the use of such melt blowing processes to lay down a web or roving of fibre that is subsequently formed into a three dimensional network using a thermoforming technique. It is well-known that such thermoforming techniques can be adapted to produce a three dimensional tubular structure. A further advantage of using the aforementioned melt blown technology in the present invention is that there are no binders or plasticisers present that could potentially transfer from the reservoir walls into the vapour. Preferably, the reservoir (bicomponent fibres) are formed by a melt blowing process.

It will be appreciated that it is also possible to make longitudinally extending elements for use in aspects of the invention using technologies other than those based on bicomponent melt-blowing. For example, the longitudinally extending element may comprise cellulose acetate (or other monocomponent fibre) plasticised with triacetin (or other plasticiser) to form a coated (bicomponent) fibre, as is well-known in the art. It is also possible to use other forms of nonwoven technologies (rather than melt-blowing) to produce a web or roving of bicomponent fibres, which can subsequently be thermally or chemically bonded or otherwise formed into the desired bonded three dimensional longitudinally extending element.

Preferably the fluid is a liquid. The fluid may be any fluid (e.g. e-liquid) which is known for use with electronic cigarettes. The fluid may comprise a solvent (for example one or more of glycerol, propylene glycol, water). The fluid may include flavouring agent and/or nicotine (e.g. dissolved in the solvent). The fluid may include 1 to 10% nicotine (by weight).

According to the present invention in a further aspect, there is provided a smoking article comprising a fluid reservoir comprising a (e.g. porous) element comprising (e.g. formed from) a plurality of bicomponent fibres; and, optionally, a fluid (e.g. disposed on or in the element).

According to the present invention in a still further aspect, there is provided a smoking article comprising: a housing; a heating element (e.g. located within the housing); a power source for at least the heating element (e.g. located within the housing); a fluid reservoir (e.g. located within the housing); and a wicking element which transfers fluid from the fluid reservoir to the heating element; wherein the fluid reservoir comprises a (e.g. porous) element comprising (e.g. formed from) a plurality of bicomponent fibres; and, optionally, a fluid (e.g. disposed on or in the element).

According to the present invention in a still further aspect, there is provided a smoking article comprising: a housing; a heating element (e.g. located within the housing); a power source for at least the heating element (e.g. located within the housing); a fluid reservoir (e.g. located within the housing); and a wicking element which transfers fluid from the fluid reservoir to the heating element; wherein the fluid reservoir comprises a longitudinally extending (e.g. porous) tubular element (e.g. of annular cross section) comprising (e.g. formed from) a plurality of bicomponent fibres; and optionally a fluid (e.g. disposed on or in the element). In this aspect, the bicomponent fibres which form the tubular element may define a single hollow channel of circular cross section extending longitudinally of (e.g. through) the tubular element.

In aspects of the invention, the fluid reservoir may be any reservoir described or disclosed herein. The wicking element (wick) draws fluid (e.g. liquid) from the reservoir and brings it into contact with the heater coil. Wicks for e-cigarettes are well known and are available from a variety of suppliers, and can be made from various materials, such as cotton, fibreglass, silica or stainless steel in different thicknesses.

Preferably the smoking article is an electronic cigarette (e-cig or e-cigarette), personal vaporizer (PV) or electronic nicotine delivery system (ENDS).

According to the present invention in a still further aspect there is provided the use of a (e.g. porous) element comprising (e.g. formed from) a plurality of bicomponent fibres as a fluid reservoir for a smoking article [e.g. an electronic cigarette (e-cig or e-cigarette), personal vaporizer (PV) or electronic nicotine delivery system (ENDS)].

According to the present invention in a further aspect there is provided a heating element for a smoking article [e.g. an electronic cigarette (e-cig or e-cigarette), personal vaporizer (PV) or electronic nicotine delivery system (ENDS)] comprising a resistance wire of resistance 2.20 to 2.5 Ω (e.g. 2.38 Ω), the resistance wire being formed as a coil or helix having 6 to 8, preferably 7, turns. The heating element may be used with smoking articles according to all aspects of the invention, and other smoking articles.

Figure 2:
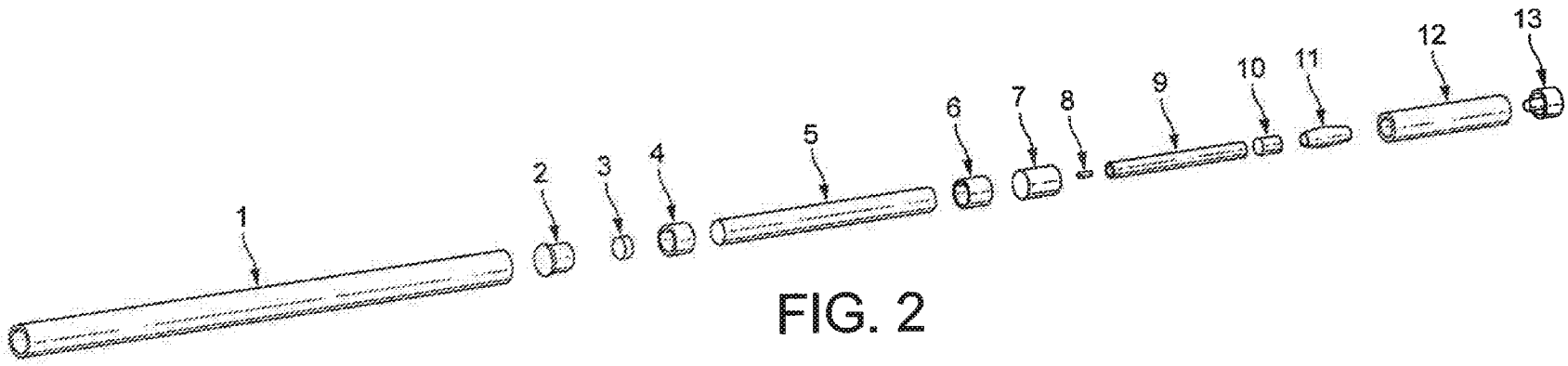

The present invention will now be illustrated with reference to the following Examples and the attached drawings in which FIG. 1 schematically illustrates (not to scale) a reservoir according to an example of the invention; and FIG. 2 shows a simplified exploded view of an e-cigarette according to an example of the invention (including a reservoir according to an example of the invention).

FIG. 1 shows a fluid reservoir 12 according to an example of the invention. The reservoir 12 comprises a longitudinally extending tubular element 20 of length 33 mm which has an annular cross section (of outer diameter 7.5 mm and inner diameter 4.25 mm, and which is formed from a plurality of bicomponent fibres. The bicomponent fibres which form the tubular element define a (single) hollow cylindrical channel 21 of circular cross section (and diameter 4.25 mm) which extends longitudinally through the element. Element 20 has a uniform cross section, so it will be appreciated that the (single) hollow cylindrical channel 21 of circular cross section extends the full length of tubular element 20.

The tubular element 20 is formed using the process described in U.S. Pat. No. 5,607,766. A plurality of bicomponent fibres having a polypropylene core surrounded by a sheath of polyethylene terephthalate was made using melt blown bicomponent technology. This web was formed into tubular rod using apparatus similar to that known for the manufacture of plasticized cellulose acetate cigarette filter elements. The tubular rod so produced was cut into discrete multiple product rods, which were then each cut into individual tubular elements 20 of 33 mm length.

The mean weight of tubular element 20 is 0.205 g. This gives a bonded fibre density in the longitudinally extending tubular element 20 of 0.21 g/cc. It will, of course, be appreciated that it is possible to adjust weight and density to meet requirements, e.g. for an element with a reduced pressure drop.

The tubular element 20 was loaded with a fluid (e-liquid) in the form of 1.2 g propylene glycol with a nicotine content of 2%.

FIG. 2 shows a simplified exploded view of an electronic cigarette according to the invention including a reservoir 12 according to the invention. The illustrated construction—of a one-part disposable device—is fairly generic and numerous examples of products with the same basic construction are known in the prior art.

The e-cigarette device is enclosed within a housing, tubular body 1. As seen in FIG. 2, at one end (the upstream end) of the tubular body 1, there is an LED end cap 2 that lights up when a flow sensor 3 (located immediately downstream of the end cap 2 within annular silicone cap 4) detects that a user is drawing on the downstream (mouth) end of the tubular body. A 3.7 V cylindrical lithium ion battery 5, located downstream of the sensor 3 and cap 4, powers the device and there is a cylindrical battery seal 6 downstream of the battery 5. Downstream of battery seal 6, a heater (heating element) 8 is contained and protected within a tubular fibreglass sleeve 9. A wick (wicking element) 10 of e.g. cotton passes through holes in sleeve 9, and the tubular sleeve 9 and wick 10 are surrounded by a tubular reservoir 12 of the invention, the sleeve described above with reference to FIG. 1. It will be appreciated that when the e-cigarette device is assembled the reservoir 12 surrounds and encloses the tubular sleeve 9 and the heater 8 located therein, with the wick extending through holes in the sleeve 9 so the wick is in contact with both the heater 8 (within sleeve 9 ) and the surrounding reservoir 12. It will also be appreciated that the dimensions, particularly the inner and outer diameters of the tubular reservoir 12, are selected so tubular sleeve 9 and wick 10 (and sleeve 11 if present) fit snugly within the cavity of the reservoir 12, and the reservoir 12 fits snugly within the housing body 1. The reservoir 12, which is porous, holds the e-liquid. In some embodiments there may be a further cotton sleeve 11 situated between reservoir 12 and sleeve 9, but this is optional (although shown in FIG. 2). Downstream of the reservoir 12/tubular sleeve 9/heater 8 assembly, a further seal 7 is provided, together with an end cap 13 at the mouth end for hygiene and convenience.

In use, as is well known, the user draws on the product (on mouth end cap 13 ) and the heater is activated by the sensor 3. Air enters the device through the end cap 2 and holes in tube 1. E-liquid is transferred from the reservoir 12 to heater 8 by wicking over or through wick (wicking element) 10, where it is vaporised and delivered to the consumer.

The prior art device used a wrapped nonwoven batt as the reservoir. According to the invention, the use of reservoir 12, which comprises bicomponent fibres, provides significant advantages in terms of vapour and nicotine delivery, as illustrated below.

EXAMPLE 1

E-cigarettes of a market-leading disposable type (herein after called 'A') were purchased and compared to those of the invention (hereinafter called 'B'). Both products were of the same dimensions and used comparable components (other than the reservoir) wherever possible. Cotton sleeve 11 was omitted from device B. The reservoir of the e-cigarette according to the invention had an outer diameter of 7.5 mm, an inner diameter of 4.25 mm, length 33 mm and weight 0.205 g (which gives a bonded fibre density of 0.21 g/cc, as set out above). It was loaded with 1.2 g propylene glycol with a nicotine content of 2% (e-liquid). This e-liquid was similar to our analysis of the e-liquid used in prior art device A, which featured a conventional rolled nonwoven batt reservoir. These two products were then analysed on a standard smoking machine using 55 ml square wave puff of 3 sec duration, taken at 2 puffs per minute. The vapour was collected for puffs 1-40, 41-80, 81-120. 121-160, 161-200 and 201-240. It is considered that 240 puffs is the typical maximum number of puffs consumers would take from disposable e-cigarettes before the device is exhausted. Consumers are likely to be dissatisfied if the device did not last 240 puffs.

The table below gives the mean total vapour and total nicotine delivered over the puff numbers in question. The mean values are based on smoking of 20 devices of each type and the co-efficient of variation of these means is also quoted. Clearly a lower CV is preferred as this provides a more consistent experience to the consumer.

| Product | Measurement | Puff Numbers 1-40 | 41-80 | 81-120 | 121-160 | 161-200 | 201-240 |
|---|---|---|---|---|---|---|---|
| A | Vapour Delivery (mg) | 66.2 | 56.5 | 50.7 | 45.3 | 37.9 | 28.9 |
| | Vapour CV (%) | 41.0 | 40.3 | 39.5 | 42.3 | 48.5 | 55.3 |
| | Nicotine Delivery (mg) | 1.04 | 0.96 | 0.89 | 0.78 | 0.68 | 0.56 |
| | Nicotine CV (%) | 42.8 | 36.5 | 34.6 | 43.3 | 46.0 | 41.7 |

-continued

| Product | Measurement | Puff Numbers 1-40 | 41-80 | 81-120 | 121-160 | 161-200 | 201-240 |
|---|---|---|---|---|---|---|---|
| B | Vapour Delivery (mg) | 105.9 | 86.9 | 77.1 | 69.3 | 63.2 | 51.3 |
| | Vapour CV (%) | 38.3 | 36.4 | 36.3 | 37.6 | 38.2 | 40.2 |
| | Nicotine Delivery (mg) | 1.87 | 1.53 | 1.36 | 1.23 | 1.15 | 0.93 |
| | Nicotine CV (%) | 32.1 | 33.6 | 34.9 | 35.6 | 35.8 | 41.9 |

It can be seen that device B of the invention advantageously provides both greater vapour delivery (average increase 50%) and greater nicotine delivery (average increase 65%), with less variability (typically 13-14% less) than market-leading conventional device A.

The applicants have also developed an improved heater, which may be used as heater element 8 in the e-cigarette device shown in FIG. 2. The 3.7 V lithium ion battery 5 is used in conjunction with a 35 mm length of 0.142 mm thick nickel chromium wire (resistance 68Ω/m, giving a total resistance of 2.38 Ω) to provide enhanced vapour delivery and improved device performance. The nickel chrome wire is coiled around a 1.5 mm fibreglass silica material with a total of 7 windings to form the heating element. This combination of battery voltage, wire rating resistance and coil setup provide an optimised power output between the maximum and minimum output voltages (4.2 V-3.4 V), before the battery is exhausted, together with improved surface contact between the wire and wicking material. Power outputs between 7.41 watts and 4.86 watts are known to provide optimal vapour creation and nicotine delivery without burning the liquid or becoming incapable of providing enough power to generate vapour. Using this improved power source, device B had a power output of 5.75 W at a voltage of 3.7 V, within this optimum range. The applicants found that 7 windings provides a high surface contact area with the wick to generate high vapour output (e.g. in comparison to device A). Earlier samples using lower resistance wire were shown to generate excessive heat, thereby causing the liquid to burn and the device housing to become hot to the touch.

EXAMPLE 1A

The extraction efficiency of the reservoir of the invention was compared with that for competitor reservoirs, which do not comprise a porous element comprising a plurality of bicomponent fibres. As for example 1, the reservoir of the e-cigarette according to the invention had an outer diameter of 7.5 mm, an inner diameter of 4.25 mm, length 33 mm and weight 0.205 g (which gives bicomponent fibres having a bonded fibre density of 0.21 g/cc, as set out above). The reservoir of the invention and the two competitor products were loaded with e-liquid (same as for Example 1), with the volume set out in Table 2 below. The products were then analysed on a standard smoking machine using 55 ml square wave puff of 3 sec duration, taken at 2 puffs per minute.

The liquid retention after the test is shown in Table 2 below. It can be seen that the reservoir of the invention provides: (i) higher TPM delivery over the first 40 puffs (160 mg vs 83 mg vs 52 mg); and (ii) average "Post Vape Liquid Retention" of 22.24% vs. comparatives of 55.28% and 66.92%. This is indicative of high extraction efficiency from the reservoir of the invention.

TABLE 2

| Device Tested | Reservoir density, g/cc | Material | Fill volume, ml | Liquid retention post vape, % MIN | MEAN | MAX | SD | CV(%) | Mean TPM delivery over initial 40 puffs, mg |
|---|---|---|---|---|---|---|---|---|---|
| Invention | 0.21 | Polyester | 1 | 16.62 | 22.24 | 28.92 | 3.63 | 16.34 | 160 |
| Competitor 1 | 0.21 | Polyester | 1.1 | 44.43 | 55.28 | 72.88 | 10.69 | 19.33 | 83 |
| Competitor 2 | 0.2 | Polyester | 0.6 | 37.42 | 61.92 | 81.50 | 15.93 | 25.73 | 52 |

The invention claimed is:

1. A smoking article comprising:

a housing;

a heating element;

a power source for at least the heating element;

a fluid reservoir; and a wicking element which transfers fluid from the fluid reservoir to the heating element;

wherein the fluid reservoir comprises an element comprising a plurality of bicomponent fibres and a fluid; and wherein the bicomponent fibers have a bonded fibre density of about 0.05 to 0.50 g/cc.

2. The smoking article according to claim 1, which is an electronic cigarette (e-cig or e-cigarette), personal vaporizer (PV) or electronic nicotine delivery system (ENDS).

3. A smoking article according to claim 1 wherein the heating element comprises a resistance wire of resistance 2.20 to 2.5 Ω, the resistance wire being formed as a coil or helix having 6 to 8 turns.

4. A smoking article comprising:

a housing;

a heating element;

a power source for at least the heating element;

a fluid reservoir; and a wicking element which transfers fluid from the fluid reservoir to the heating element;

wherein the fluid reservoir comprises a longitudinally extending tubular element comprising a plurality of bicomponent fibres and a fluid; and wherein the bicomponent fibers have a bonded fibre density of about 0.05 to 0.50 g/cc and a fluid.

5. The smoking article according to claim 4, which is an electronic cigarette (e-cig or e-cigarette), personal vaporizer (PV) or electronic nicotine delivery system (ENDS).

* * * * *